US012650277B2

(12) United States Patent
Lyman

(10) Patent No.: US 12,650,277 B2
(45) Date of Patent: Jun. 9, 2026

(54) SHOOTING BENCH SYSTEM

(71) Applicant: Brent Lyman, Cedar Falls, IA (US)

(72) Inventor: Brent Lyman, Cedar Falls, IA (US)

( * ) Notice: Subject to any disclaimer, the term of this patent is extended or adjusted under 35 U.S.C. 154(b) by 0 days.

(21) Appl. No.: 19/035,647

(22) Filed: Jan. 23, 2025

(65) Prior Publication Data

US 2025/0237459 A1 Jul. 24, 2025

Related U.S. Application Data

(60) Provisional application No. 63/624,089, filed on Jan. 23, 2024.

(51) Int. Cl.
*F41A 23/02* (2006.01)
*F41A 23/16* (2006.01)
*F41A 23/36* (2006.01)

(52) U.S. Cl.
CPC ..... *F41A 23/36* (2013.01); *F41A 23/02* (2013.01)

(58) Field of Classification Search
CPC ..... F41A 23/00; F41A 23/02; F41A 23/04; F41A 23/06; F41A 23/16; F41A 23/36
USPC ..... 42/94
See application file for complete search history.

(56) References Cited

U.S. PATENT DOCUMENTS 6,269,578 B1 * 8/2001 Callegari ..... F41A 23/02 297/172
6,871,440 B2 * 3/2005 Highfill ..... F41J 9/18 89/37.04
6,935,064 B1 8/2005 Thompson
7,152,358 B1 * 12/2006 LeAnna ..... F41A 23/02 297/170
7,731,278 B1 * 6/2010 Brownlee ..... F41C 27/22 248/170
8,166,695 B2 5/2012 Pippin
8,464,460 B1 * 6/2013 Runyan ..... F41J 1/00 296/182.1
2006/0196725 A1 * 9/2006 Lee ..... A01M 31/02 182/127

OTHER PUBLICATIONS

Hitch-mounted Shooting Bench, retrieved from the internet, retrieved on Jan. 23, 2025; <URL: https://www.thefirearmblog.com/blog/2012/03/30/hitch-mounted-shooting-bench/>.

(Continued)

*Primary Examiner* — Bret Hayes

(57) ABSTRACT

A shooting bench is an adaptable device for a firearm, that is designed to be used with a receiver hitch on a vehicle such as a truck or UTV. The device has two trailer jacks used for support and level adjustment which makes the bench very stable and ideal for long range shooting. Further, the device can be used on the ground with a leveling kit for stability and mounted to an elevated hunting blind. Furthermore, the device can rotate 360 degrees and is adjustable with a hand brake that can be operated while seated, locking the bench at any angle. The adjustable seat can extend upwards up to 8 inches and is designed to engage with supporting elements and structures such as bipods, sandbags, "lead sleds" and similar devices. Thus, the device is a hitch receiver mounted shooting bench with high portability that secures to an external vehicle.

16 Claims, 9 Drawing Sheets

(56) References Cited

OTHER PUBLICATIONS

Shooting Bench, retrieved from the internet, retrieved on Jan. 23, 2025; <URL: https://www.morraccuracy.com/store/p13/Shooting_Bench.html>.
MTM Case-Gard Predator Shooting Rest, retrieved from the internet, retrieved on Jan. 23, 2025; <URL: https://www.justairguns.co.uk/mtm-case-gard-predator-shooting-rest/>.

* cited by examiner

SHOOTING BENCH SYSTEM

The current application claims a priority to the U.S. provisional patent application Ser. No. 63/624,089 filed on Jan. 23, 2024.

FIELD OF THE INVENTION

The present invention relates generally to a shooting bench. More specifically, the present invention is a device that is hitch mounted with a leveling kit to provide proper shooting positioning.

BACKGROUND OF THE INVENTION

Portable shooting benches are designed to facilitate varmint shooting. Varmints are relatively small targets, frequently shot at close to long ranges, typically 400 yards and further. A very stable bench is required for accurate shooting at these ranges. Varmints can be spread over a large area, so a shooting bench that is mobile and very quick to set up and take down is a big advantage. Another advantage of the receiver mounted shooting bench is that the tabletop is approximately 60 inches above the ground, so in hilly terrain and/or tall grass, this helps to find and shoot targets. The ground version is approximately 42 inches above ground which is still much superior to lying prone on the ground trying to find and shoot long range targets. This bench also works very well for sighting with gun scopes, starting at close range and having the ability to move to long range targets quickly.

An objective of the present invention is to provide users with a receiver mounted shooting bench, to facilitate varmint shooting. The present invention intends to provide users with a device that can quickly and conveniently be set up and taken down. In order to accomplish that, a preferred embodiment of the present invention comprises a lower frame, an upper frame, a shooting table, and a seat system. Thus, the present invention is a hitch receiver mounted shooting bench with high portability that secures to an external vehicle.

SUMMARY OF THE INVENTION

The present invention is a shooting bench for a firearm that is designed to be used with a receiver hitch on a vehicle such as a truck or UTV. The shooting bench also has two trailer jacks used for support and level adjustment which makes the bench very stable, ideal for long range shooting. These two jacks can also be rotated up for short range transport, which makes this shooting bench mobile. In addition, this same bench can be used on the ground with a leveling kit for stability and mounted to an elevated hunting blind. In additional embodiments, the present invention can rotate 360 degrees. It is adjustable with a hand brake that can be operated while seated, locking the bench at any angle. The present invention is designed to accommodate left-handed or right-handed shooters. It also has an adjustable seat which can extend upwards up to 8 inches based on the shooter's preference. The present invention top is designed to engage with supporting elements and structures such as bipods, sandbags, "lead sleds" and similar devices. For long range transport on the receiver mounted embodiment, the seat, tabletop and two jacks can be removed quickly. These components can be put in a truck or UTV box. If multiple shooting benches need to be hauled long range in one vehicle, the upper frame can be removed from the lower frame in a few minutes with one 13/16 in wrench. Thus, the present invention is a hitch receiver mounted shooting bench with high portability that secures to an external vehicle.

DETAILED DESCRIPTION OF THE INVENTION

Figure 1:
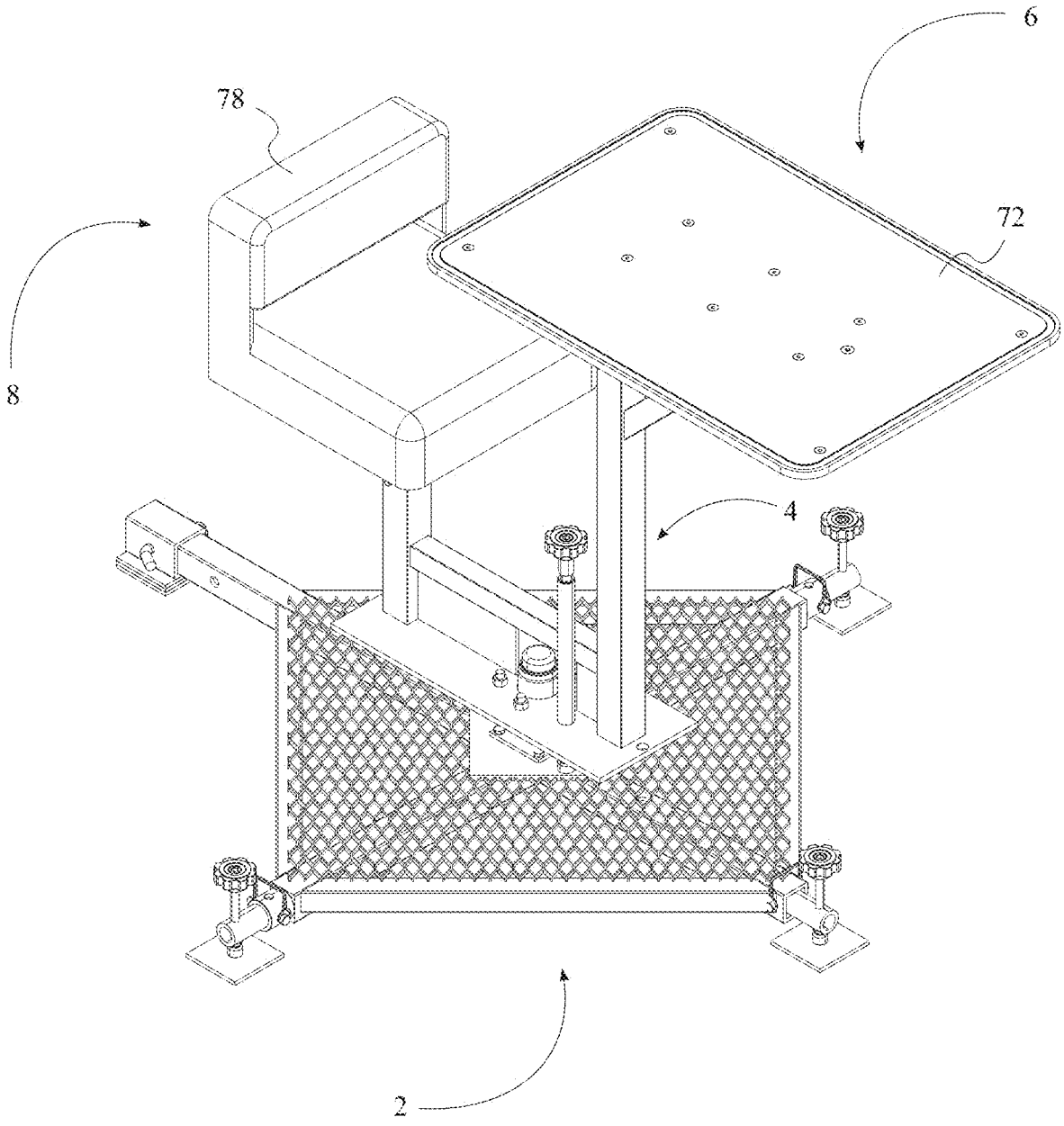
FIG. 1 is a top-front-right perspective view of a shooting bench system according to a preferred embodiment of the present invention.

All illustrations of the drawings are for the purpose of describing selected versions of the present invention and are not intended to limit the scope of the present invention.

The following description is in reference to FIG. 1 through FIG. 9. The present invention discloses a portable shooting bench system for varmint shooting. An objective of the present invention is to provide users with a shooting bench for a firearm that can be secured to a receiver hitch on a vehicle. Furthermore, the present invention intends to provide users with a device that can rotate 360 degrees. To accomplish this, a preferred embodiment of the present invention comprises an upper frame 4, a lower frame 2, a shooting table unit 6, a seat system 8, and a bearing hub system 10. Many of these components allow for the user to adjust the height and level of the present invention to obtain a level shooting surface. Preferably, the upper frame 4 is secured centrally on top of the lower frame 2. To that end, the upper frame 4 is mounted onto the central plate 12. In other words, the upper frame 4 connects with the lower frame 2 via the central plate 12. The upper frame 4 is designed with a metal material utilized to form a rectangular shaped base. However, the upper frame 4 may comprise any other material, shape, components, arrangement of components, etc. that are known to one of ordinary skill in the art, as long as the intends of the present invention are not altered. The shooting table unit 6 is positioned along the front top side of the upper frame 4 while the seat system 8 is secured along the rear top side of the upper frame 4. The central plate 12 is a flat square plate that is positioned within the middle of the lower frame 2. The central plate 12 is designed with a metal material that allows the upper frame 4 to secure to the lower frame 2.

Figure 3:
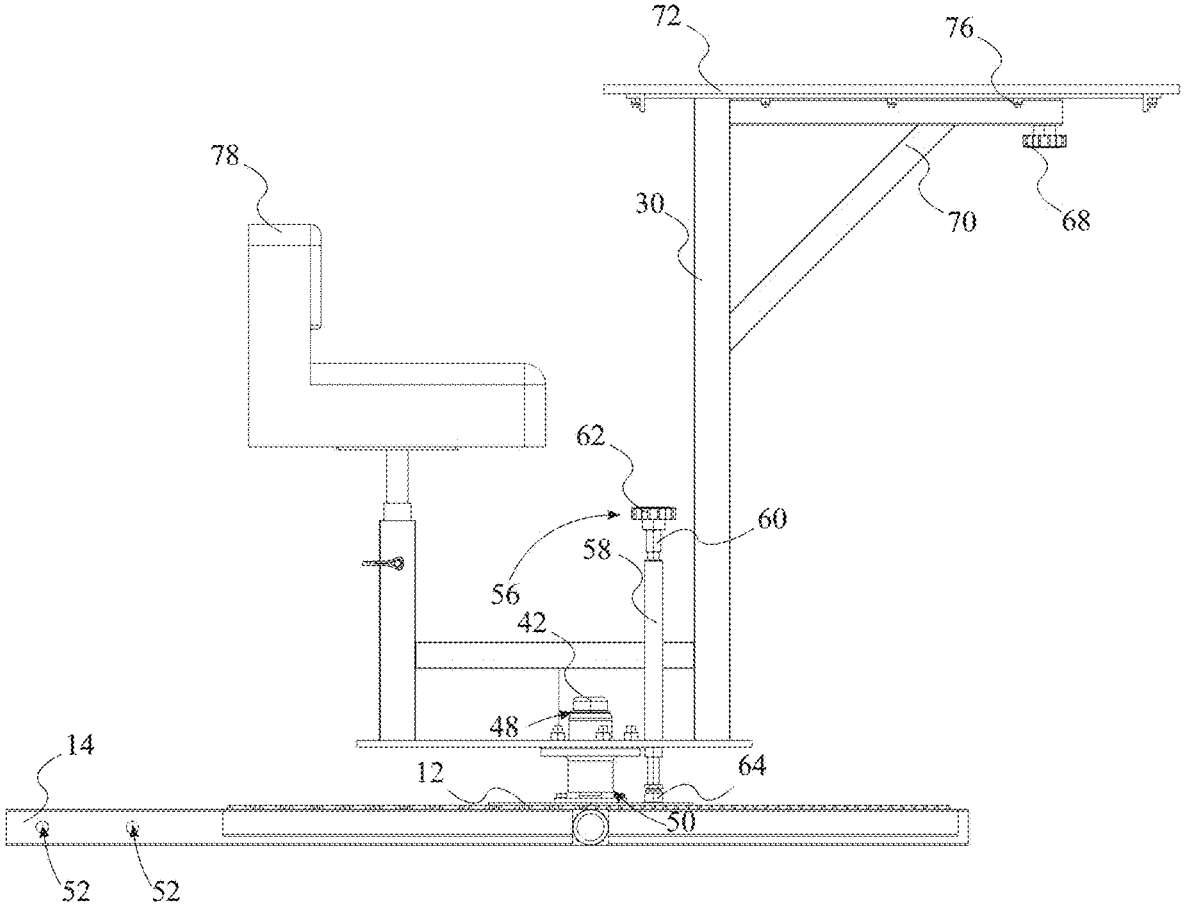
FIG. 3 is a right-side elevational view of the present invention.
Figure 5:
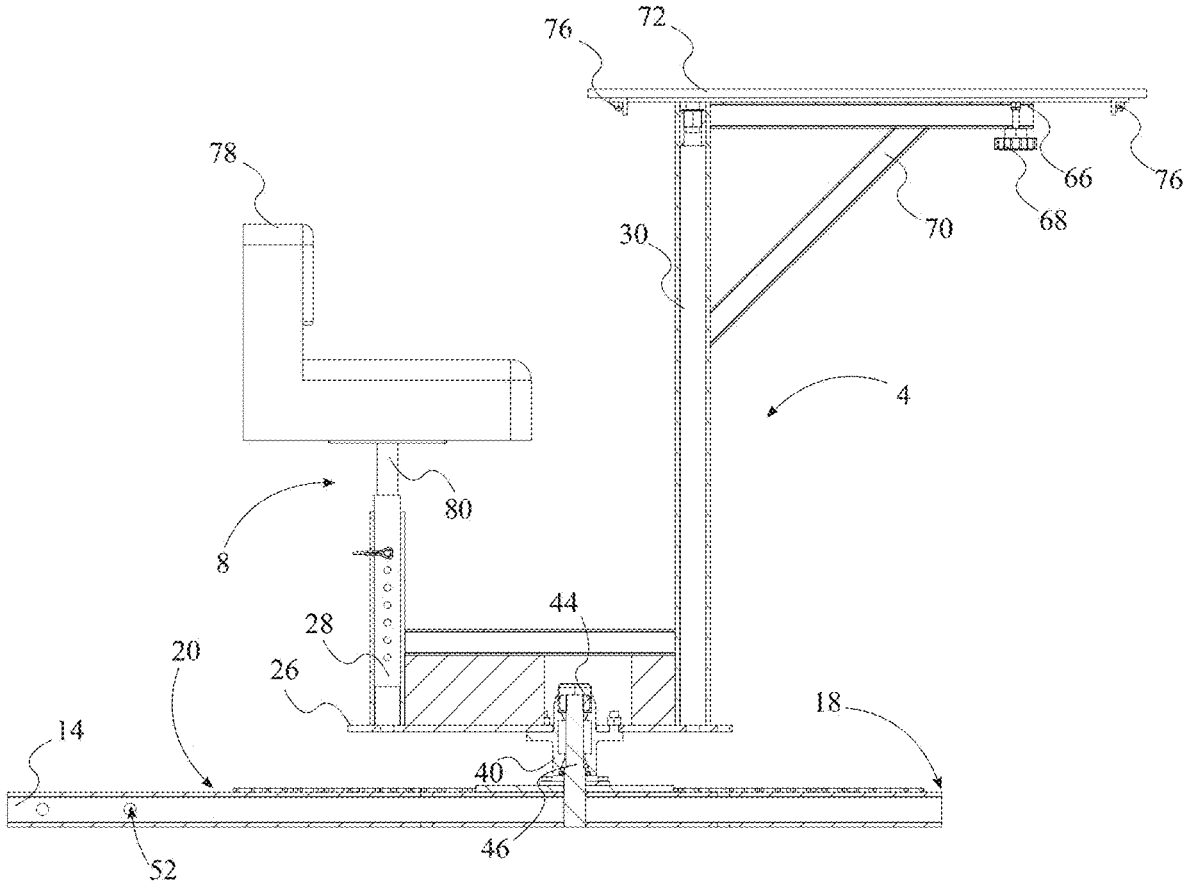
FIG. 5 is a sectional view of the present invention taken along A-A' in FIG. 4.
Figure 8:
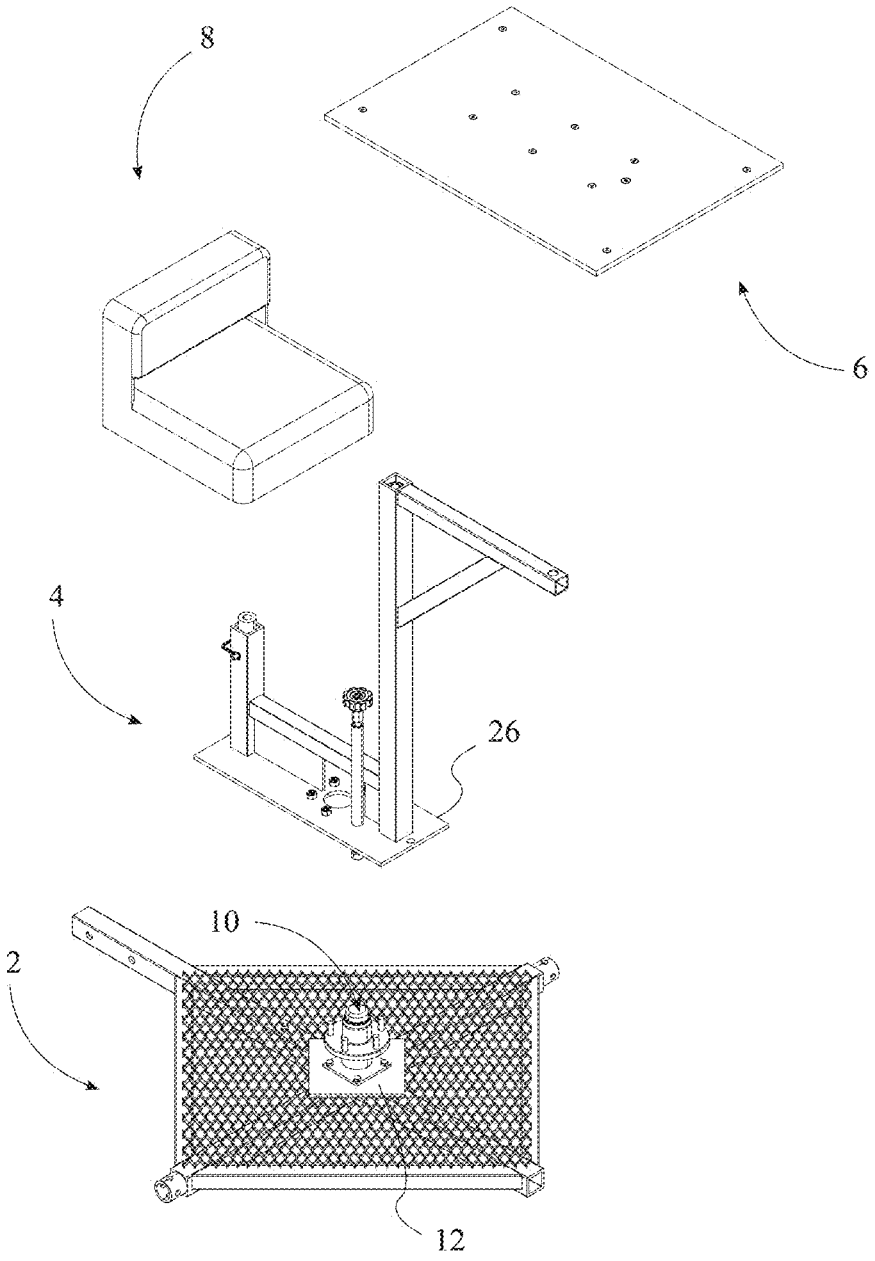
FIG. 8 is an exploded view of the present invention.

The present invention provides a bottom structure that secures a vehicle receiver hitch and the ground below with the lower frame 2. The lower frame 2 is made of a metal material with a flat square shape that can be secured to a vehicle such as an SUV, van, truck, etc. In its preferred embodiment, the lower frame 2 comprises a hitch mount 14, a non-slip floor 16, a front frame end 18, and a rear frame end 20. The non-slip floor 16 is a metal grating material that is positioned along the top surface of the lower frame 2 that provides sure footing during snowy, rainy and muddy conditions. Preferably, the non-slip floor 16 comprises a first-floor surface 22 and a second-floor surface 24, wherein the first-floor surface 22 is positioned opposite the second-floor surface 24 about the non-slip floor 16. In other words, the first-floor surface 22 constitutes a top surface of the non-slip floor 16, and the second-floor surface 24 constitutes a bottom surface of the non-slip floor 16. As seen in FIG. 3 and FIG. 8, the central plate 12 is mounted centrally onto the first-floor surface 22. It should be further noted that the lower frame 2 can be created in many various shapes and sizes and the non-slip flooring could be designed in various ways to provide a proper top surface while still staying within the scope of the present invention. Further, the front frame end 18 is positioned opposite to the rear frame end 20 about the lower frame 2. The hitch mount 14 is a hollow rectangular member that extends along the rear corner of the lower frame 2 as shown in FIG. 5. In other words, the hitch mount 14 is mounted adjacent to the rear frame end 20. The hitch mount 14 allows for the present invention to be secured to a receiver hitch along a vehicle. Thus, the present invention is a hitch receiver mounted shooting bench with high portability that secures to an external vehicle.

Figure 4:
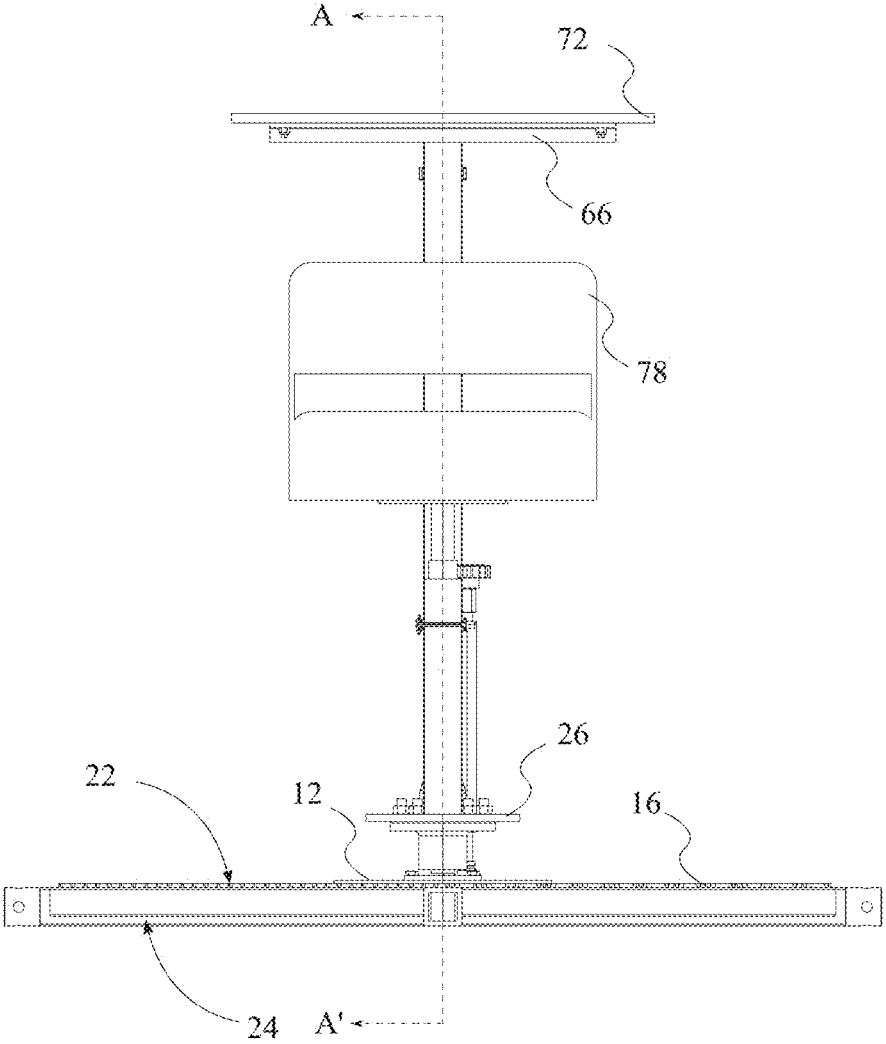
FIG. 4 is a rear elevational view of the present invention.

Continuing with the preferred embodiment, the upper frame 4 comprises a support plate 26, a chair receiving post 28, and a shooting table post 30. The support plate 26 is positioned along the bottom of the upper frame 4. The support plate 26 is a flat rectangular plate that provides structural support for the upper frame 4. As seen in FIG. 4, the support plate 26 is mounted onto the central plate 12 through the bearing hub system 10, and the bearing hub system 10 extends through the support plate 26 onto the central plate 12. The bearing hub system 10 is a cylindrical shaped system that secures the lower frame 2 to the upper frame 4, allowing the upper frame 4 to rotate 360 degrees with respect to the lower frame 2. In other words, the support plate 26 is rotatably mounted onto the central plate 12 by the bearing hub system 10.

As seen in FIG. 5, the shooting table post 30 and the chair receiving post 28 are mounted normal to the support plate 26, opposite the central plate 12. Further, the shooting table post 30 is positioned parallel and offset from the chair receiving post 28. In other words, the chair receiving post 28 extends upwards from the top rear surface of the support plate 26 while the shooting table post 30 extends upwards from the top front surface of the support plate 26 shown in FIG. 5. The chair receiving post 28 is a hollow vertical rectangular member, while the shooting table post 30 is an L-shaped hollow rectangular piece. Furthermore, the shooting table unit 6 is mounted onto the shooting table post 30, and the seat system 8 is mounted within the chair receiving post 28. Thus, the shooting table unit 6 enables the user to set up shooting equipment on the table, while being comfortable seated on the seat system 8.

A more detailed description of the present invention follows.

Figure 6:
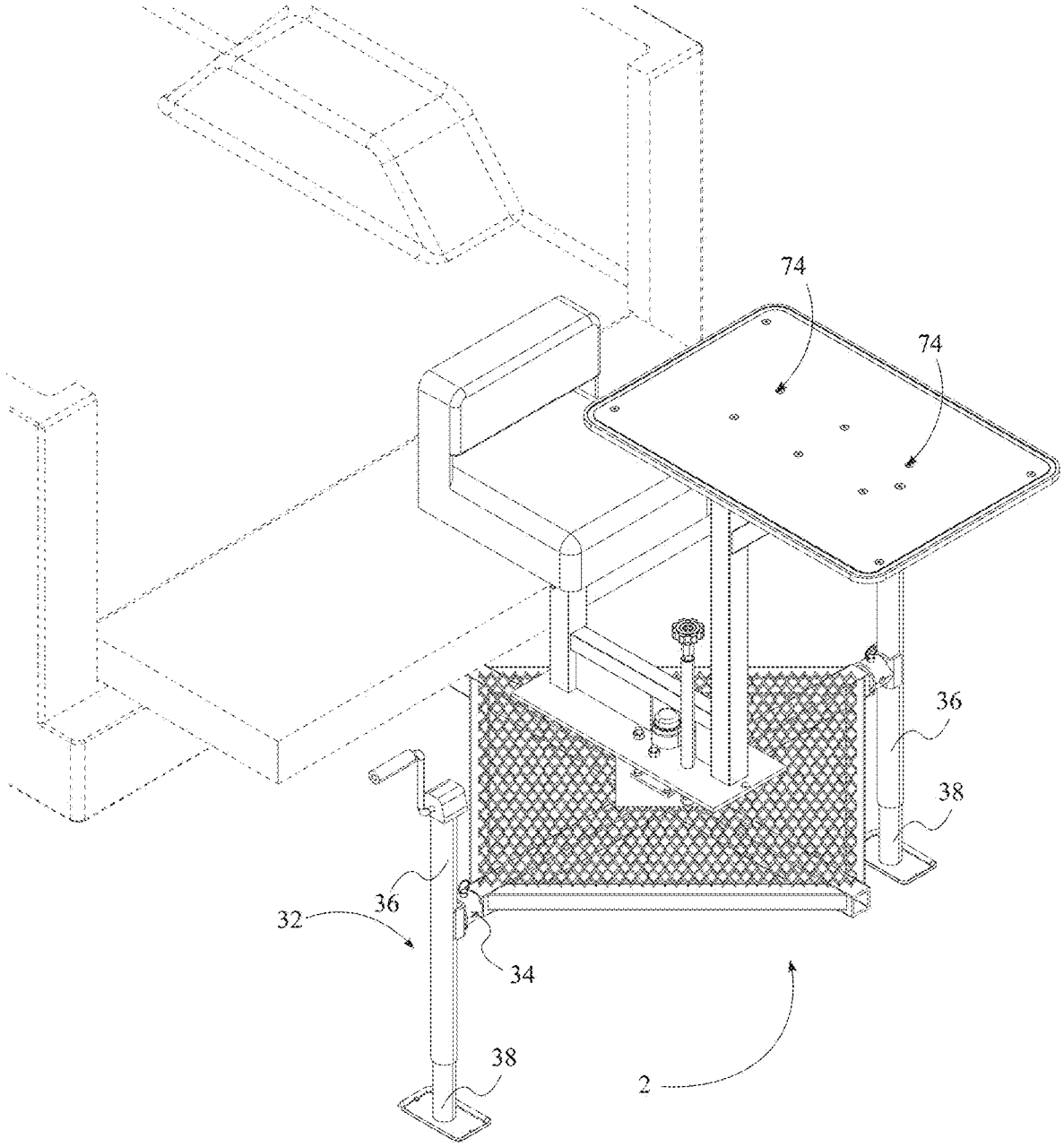
FIG. 6 is a top-front-right perspective view of an alternate embodiment of the present invention, wherein a plurality of trailer jacks is mounted on the sides of the lower frame, and wherein the present invention is hitch mounted onto the back of a truck.
Figure 7:
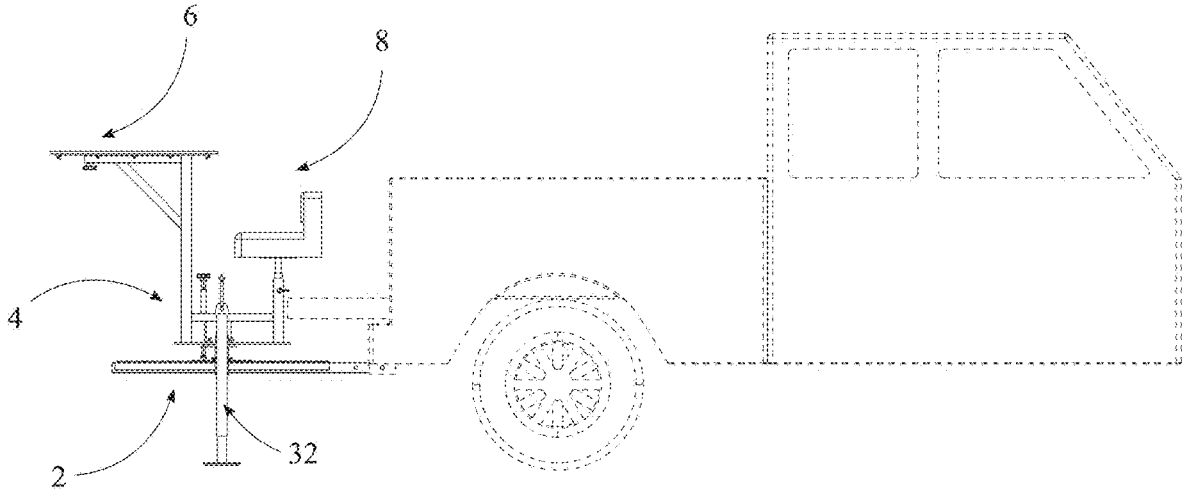
FIG. 7 is a left side elevational view of the alternative embodiment.

In order to provide additional stability to the entire shooting bench set up, or as a first configuration, the present invention may further comprise a plurality of trailer jacks 32. As seen in FIG. 6 and FIG. 7, each of the plurality of trailer jacks 32 may comprise a rotating mount 34, a hollow frame 36, and an extending shaft 38. Preferably, the extending shaft 38 is telescopically mounted into the hollow frame 36, and the hollow frame 36 is rotatably mounted to the lower frame 2 by the rotating mount 34. In other words, the extending shaft 38 extends and compresses within the hollow frame 36*s* to allow the height of the lower frame 2 to be adjusted depending on the slope and terrain of the ground below. Further, the rotating mount 34 is peripherally positioned to the lower frame 2, and the plurality of trailer jacks 32 is distributed around the lower frame 2. The rotating mount 34 secures the plurality of trailer jacks 32 to the lower frame 2 and allows for the plurality of trailer jacks 32 to rotate 90 degrees to a standing position and a stored position. This design allows for the plurality of trailer jacks 32 to be positioned along the floor and provides a $2^{nd}$ and $3^{rd}$ point of support along with the hitch mount 14 as seen in FIG. 6. In other words, and as seen in FIG. 6, the plurality of trailer jacks 32 is positioned along the left and right side of the lower frame 2.

According to the preferred embodiment, the bearing hub system 10 comprises a cylindrical housing 40, a dust cover 42, a plurality of roller bearings 44, and a spindle 46. The cylindrical housing 40 preferably comprise an open housing end 48 and a closed housing end 50, wherein the dust cover 42 is hermetically mounted across the open housing end 48. The dust cover 42 is a circular shaped component that prevents dust from entering the bearing hub system 10. The dust cover 42 has a seal that is positioned below the dust cover 42 to create an airtight seal to prevent lubricant from exiting the bearing hub system 10. As seen in FIG. 5, the cylindrical housing 40 traverses through the support plate 26. In other words, the support plate 26 is laterally mounted around the cylindrical housing 40. In order to enable rotation of the upper frame 4, the plurality of roller bearings 44 is rotatably mounted within the cylindrical housing 40 and the spindle 46 is rotatably mounted through the closed housing end 50 and into the cylindrical housing 40. More specifically, the plurality of rolling bearings is positioned along the circumference of the spindle 46 and allows for the bearing hub system 10 to facilitate rotational motion. As seen in FIG. 5, the spindle 46 is positioned centrally within the bearing hub system 10 and the spindle 46 is a cylindrical member that traverses vertically. More specifically, the spindle 46 is torsionally mounted to each of the plurality of roller bearings 44, and the spindle 46 is torsionally mounted onto the central plate 12. However, it should be noted that the rotating hub may comprise any other technology, components, and arrangement of components that are known to one of ordinary skill in the art, as long as the objectives of the present invention are not altered.

In the preferred embodiment, the hitch mount 14 is designed with a plurality of hitch holes 52 that traverse along the left and right side of the hitch mount 14, designed to allow the hitch mount 14 to secure to a standard vehicle receiver hitch. In other words, the lower frame 2 may further comprise a plurality of hitch holes 52, wherein the plurality of hitch holes 52 laterally traverses through the hitch mount 14. The plurality of hitch holes 52 also allows for the present invention to be mounted at varying lengths from the external vehicle to keep the center of gravity of the present invention as stable as possible depending on the weight of the user and the weight of the user's equipment.

Continuing with the preferred embodiment, the lower frame 2 further comprises a plurality of floor holes 54, wherein the plurality of floor holes 54 traverses through the non-slip floor 16. In other words, the plurality of floor holes 54 allows water and liquid to pass through while providing a structurally sound surface to support the weight of a user's foot stepping upon the lower frame 2.

According to the preferred embodiment, the present invention comprises a braking system 56 that helps to keep the seat locked in one place without rotating about the lower frame 2. In other words, the braking system 56 is a hand brake that secures the seat system 8 in place when the user does not want the upper frame 4 to rotate on the lower frame 2. Accordingly, the braking system 56 is operatively connected between the upper frame 4 and the lower frame 2, wherein the braking system 56 is used to selectively lock the rotation of the upper frame 4 in relation to the lower frame 2. In the preferred embodiment, the braking system 56 comprises a braking tube 58, a threaded pole 60, a braking knob 62, a braking toggle pad 64. Preferably, the braking tube 58 is mounted onto the support plate 26 and the threaded pole 60 is threadably engaged into the braking tube 58. The threaded pole 60 is a pole with a threaded outer surface with a spiral pattern. This allows for the threaded pole 60 to traverse through the cylindrical braking system 56 or braking tube 58 and move upwards and downwards as the threaded pole 60 rotates. The braking knob 62 is a cylindrical component that rotates and turns the attached braking threaded pole 60. In other words, the braking knob 62 is terminally mounted to the threaded pole 60, and a user may operate the braking system 56 by adjusting the braking knob 62 while being seated on the seat system 8. Secured to the bottom of the braking threaded pole 60 is the braking toggle pad 64. In other words, the braking toggle pad 64 is terminally mounted to the threaded pole 60, opposite to the braking knob 62. The braking toggle pad 64 is a rubber material that is secured along the bottom of the braking threaded pole 60 and contacts the central plate 12. As the braking toggle pad 64 contacts the central plate 12, the braking toggle pad 64 creates a frictional force to secure the upper frame 4 in position with respect to the lower frame 2 as seen in FIG. 3. However, it should be noted that the braking system 56 may comprise any other technology, components, and arrangement of components that are known to one of ordinary skill in the art, as long as the objectives of the present invention are not altered.

Continuing with the preferred embodiment, the shooting table unit 6 comprises a table support frame 66, a knobbed fastener 68, a counterfort 70, a tabletop 72, a plurality of receiving holes 74, and a plurality of external connectors 76. The shooting table unit 6 connects to the upper frame 4 along the shooting table post 30 and allows for the user to place heavy items such as sandbags, lead sleds, and firearms upon the present invention. Preferably, the counterfort 70 is angularly connected between the table support frame 66 and the shooting table post 30. More specifically, the counterfort 70 creates a 45-degree angle with the shooting table as seen in FIG. 3. The counterfort 70 is a rectangular metal post that provides structural support. The plurality of receiving holes 74 allows for the shooting table to be secured to the table support frame 66 via the plurality of external connectors 76. To that end, the plurality of receiving holes 74 traverses through the tabletop 72. Further, each of the plurality of external connectors 76 is integrated through the table support frame 66, wherein each of the plurality of external connectors 76 is threadably engaged to a corresponding hole from the plurality of receiving holes 74. The knobbed fastener 68 allows for the shooting table to easily be removed from the upper frame 4 during transport. Accordingly, the table support frame 66 is detachably attached to the shooting table post 30 by the knobbed fastener 68. Thus, no tools such as wrenches or screw drivers are needed to remove the tabletop 72 from the upper frame 4. Furthermore, the tabletop 72 may be removed or replaced with a smaller different tabletop 72, based on the user's preference.

Figure 2:
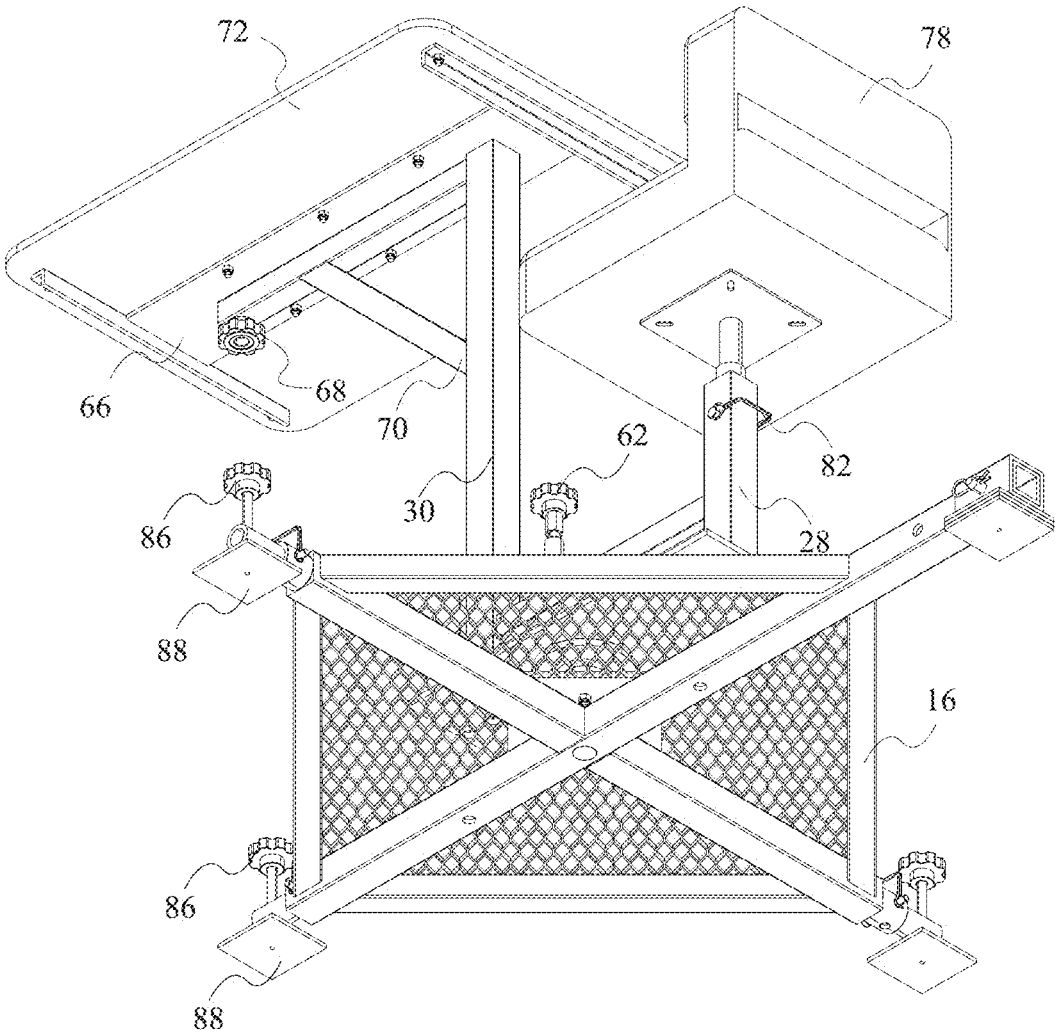
FIG. 2 is a bottom-rear-left perspective view of the present invention.

According to the preferred embodiment, the seat system 8 comprises a seat cushion 78, a seat post 80, and an adjustable seat pin 82. Preferably, the seat cushion 78 is terminally mounted onto the seat post 80, and the seat post 80 is rotatably and telescopically mounted into the chair receiving post 28. In other words, the seat cushion 78 is positioned along the top side of the rotating seat mount as shown in FIG. 2, to allow the user to sit upon the present invention. Further, the seat cushion 78 may comprise a spring that absorbs weight as the user sits upon the seat and slightly compresses downwards along the rotating seat mount. The seat post 80 allows for the seat system 8 to raise and lower within the chair receiving post 28, while also enabling rotation. In order to adjust the height of the seat cushion 78, the adjustable seat pin 82 is provided. In other words, the adjustable seat pin 82 is operatively integrated between the seat post 80 and the chair receiving post 28, wherein the adjustable seat pin 82 is used to adjust an elevation of the seat cushion 78 in relation to the lower frame 2.

In reference to FIG. 2 and FIG. 3, and according to first alternative embodiment, the present invention comprises a plurality of levelers 84, wherein each of the plurality of levelers 84 may comprise a leveling mechanism 86 and an extending leg 88. The leveling mechanism 86 and the extending leg 88 allow for the lower frame 2 to be placed upon the ground and not secured to an external vehicle. More specifically, the plurality of levelers 84 allows for the lower frame 2 to be adjusted to the proper flat level, to ensure proper shooting conditions. To accomplish this, the extending leg 88 of each of the plurality of levelers 84 is radially mounted to the lower frame 2, and the leveling mechanism 86 is terminally mounted to the extending leg 88, offset from the lower frame 2. However, it should be noted that the levelers may comprise any other technology, components, and arrangement of components that are known to one of ordinary skill in the art, as long as the objectives of the present invention are not altered.

Figure 9:
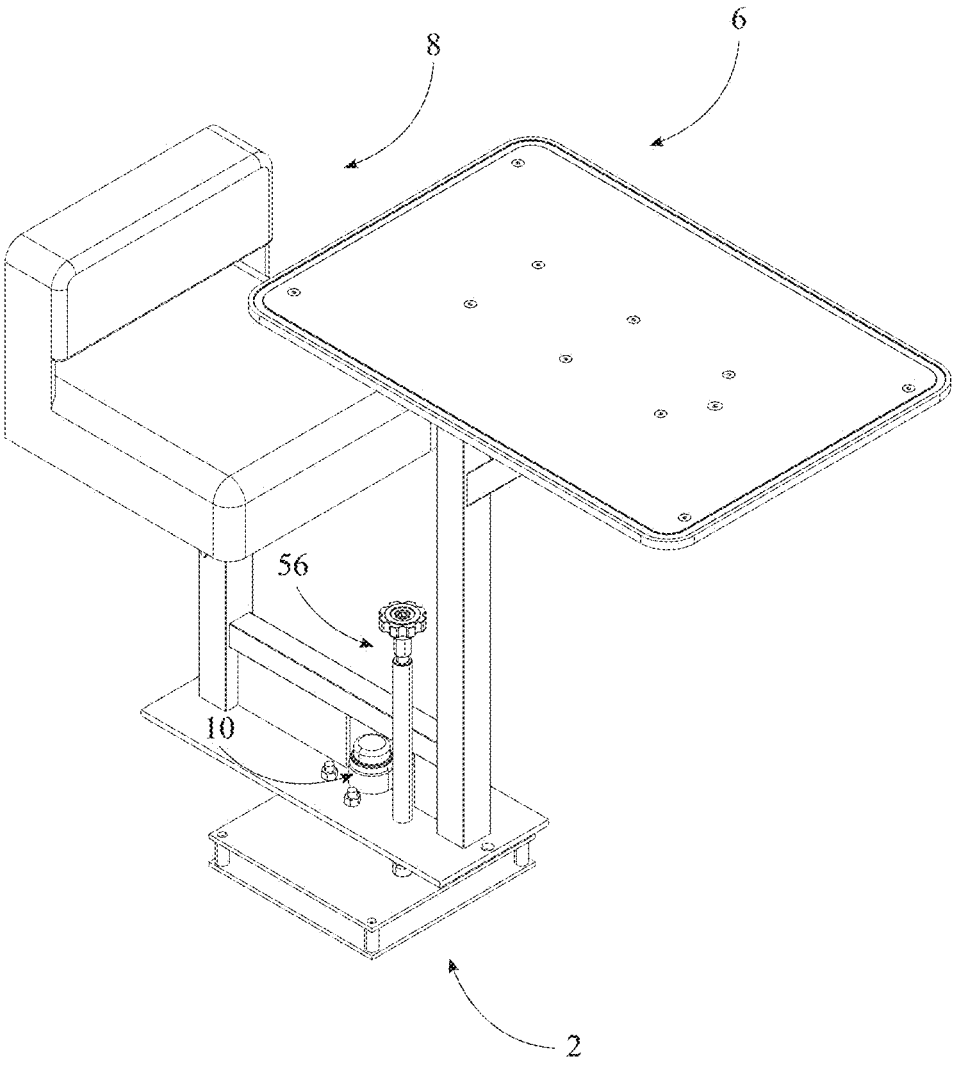
FIG. 9 is an alternate embodiment of the present invention, wherein the lower frame comprises just a square mounting attachment.

In reference to FIG. 9, and according to a second alternative embodiment, the lower frame 2 may be just a mounting platform that can be mounted onto any elevated surface.

Although the invention has been explained in relation to its preferred embodiment, it is to be understood that many other possible modifications and variations can be made without departing from the spirit and scope of the invention as hereinafter claimed.

What is claimed is:

1. A shooting bench system comprising:

a lower frame;

an upper frame;

a shooting table unit;

a seat system;

a bearing hub system;

the lower frame comprising a central plate, a hitch mount, a non-slip floor, a front frame end, and a rear frame end;

the non-slip floor comprising a first floor surface and a second floor surface;

the upper frame comprising a support plate, a chair receiving post, and a shooting table post;

the front frame end being positioned opposite to the rear frame end about the lower frame;

the first floor surface being positioned opposite the second floor surface about the non-slip floor;

the hitch mount being mounted adjacent to the rear frame end;

the central plate being centrally mounted onto the first floor surface;

the support plate being rotatably mounted onto the central plate by the bearing hub system;

the shooting table post and the chair receiving post being mounted normal to the support plate, opposite the central plate;

the shooting table post being positioned parallel and offset from the chair receiving post;

the shooting table unit being mounted onto the shooting table post; and the seat system being mounted within the chair receiving post.

2. The shooting bench system of claim 1 comprising:

a plurality of trailer jacks;

each of the plurality of trailer jacks comprising a rotating mount, a hollow frame, and an extending shaft;

the extending shaft being telescopically mounted into the hollow frame;

the hollow frame being rotatably mounted to the lower frame by the rotating mount;

the rotating mount being peripherally positioned to the lower frame; and the plurality of trailer jacks being distributed around the lower frame.

3. The shooting bench system of claim 1 further comprising:

the bearing hub system comprising a cylindrical housing, a dust cover, a plurality of roller bearings, and a spindle;

the cylindrical housing comprising an open housing end and a closed housing end;

the dust cover being hermetically mounted across the open housing end;

the support plate being laterally mounted around the cylindrical housing;

the plurality of roller bearings being rotatably mounted within the cylindrical housing;

the spindle being rotatably mounted through the closed housing end and into the cylindrical housing;

the spindle being torsionally mounted to each of the plurality of roller bearings; and the spindle being torsionally mounted onto the central plate.

4. The shooting bench system of claim 1 comprising:

the lower frame further comprising a plurality of hitch holes; and the plurality of hitch holes laterally traversing through the hitch mount.

5. The shooting bench system of claim 1 comprising:

the lower frame further comprising a plurality of floor holes; and the plurality of floor holes traversing through the non-slip floor.

6. The shooting bench system of claim 1 further comprising:

a braking system; and the braking system being operatively connected between the upper frame and the lower frame, wherein the braking system is used to selectively lock the rotation of the upper frame in relation to the lower frame.

7. The shooting bench system of claim 6 further comprising:

the braking system comprising a braking tube, a threaded pole, a braking knob, a braking toggle pad;

the braking tube being mounted onto the support plate;

the threaded pole being threadably engaged into the braking tube;

the braking knob being terminally mounted to the threaded pole; and the braking toggle pad being terminally mounted to the threaded pole, opposite to the braking knob.

8. The shooting bench system of claim 1 further comprising:

the shooting table unit comprising a table support frame, a knobbed fastener, a counterfort, a tabletop, a plurality of receiving holes, and a plurality of external connectors;

the counterfort being angularly connected between the table support frame and the shooting table post;

the plurality of receiving holes traversing through the tabletop;

each of the plurality of external connectors being integrated through the table support frame;

each of the plurality of external connectors threadably engaging a corresponding hole from the plurality of receiving holes; and the table support frame being detachably attached to the shooting table post by the knobbed fastener.

9. The shooting bench system of claim 1 further comprising:

the seat system comprising a seat cushion, a seat post, and an adjustable seat pin;

the seat cushion being terminally mounted onto the seat post;

the seat post being rotatably and telescopically mounted into the chair receiving post; and the adjustable seat pin being operatively integrated between the seat post and the chair receiving post, wherein the adjustable seat pin is used to adjust an elevation of the seat cushion in relation to the lower frame.

10. The shooting bench system of claim 1 comprising:

a plurality of levelers;

each of the plurality of levelers comprising a leveling mechanism and an extending leg;

the extending leg of each of the plurality of levelers being radially mounted to the lower frame; and the leveling mechanism being terminally mounted to the extending leg, offset from the lower frame.

11. A shooting bench system comprising:

a lower frame;

an upper frame;

a shooting table unit;

a seat system;

a bearing hub system;

a braking system;

the lower frame comprising a central plate, a hitch mount, a non-slip floor, a plurality of hitch holes, a front frame end, and a rear frame end;

the non-slip floor comprising a first floor surface and a second floor surface;

the upper frame comprising a support plate, a chair receiving post, and a shooting table post;

the front frame end being positioned opposite to the rear frame end about the lower frame;

the first floor surface being positioned opposite the second floor surface about the non-slip floor;

the hitch mount being mounted adjacent to the rear frame end;

the plurality of floor holes traversing through the non-slip floor;

the central plate being centrally mounted onto the first floor surface;

the support plate being rotatably mounted onto the central plate by the bearing hub system;

the shooting table post and the chair receiving post being mounted normal to the support plate, opposite the central plate;

the shooting table post being positioned parallel and offset from the chair receiving post;

the shooting table unit being mounted onto the shooting table post;

the seat system being mounted within the chair receiving post; and the braking system being operatively connected between the upper frame and the lower frame, wherein the braking system is used to selectively lock the rotation of the upper frame in relation to the lower frame.

12. The shooting bench system of claim 11 comprising:

a plurality of trailer jacks;

each of the plurality of trailer jacks comprising a rotating mount, a hollow frame, and an extending shaft;

the extending shaft being telescopically mounted into the hollow frame;

the hollow frame being rotatably mounted to the lower frame by the rotating mount;

the rotating mount being peripherally positioned to the lower frame; and the plurality of trailer jacks being distributed around the lower frame.

13. The shooting bench system of claim 11 further comprising:

the shooting table unit comprising a table support frame, a knobbed fastener, a counterfort, a tabletop, a plurality of receiving holes, and a plurality of external connectors;

the counterfort being angularly connected between the table support frame and the shooting table post;

the plurality of receiving holes traversing through the tabletop;

each of the plurality of external connectors being integrated through the table support frame;

each of the plurality of external connectors threadably engaging a corresponding hole from the plurality of receiving holes; and the table support frame being detachably attached to the shooting table post by the knobbed fastener.

14. The shooting bench system of claim 11 further comprising:

the seat system comprising a seat cushion, a seat post, and an adjustable seat pin;

the seat cushion being terminally mounted onto the seat post;

the seat post being rotatably and telescopically mounted into the chair receiving post; and the adjustable seat pin being operatively integrated between the seat post and the chair receiving post, wherein the adjustable seat pin is used to adjust an elevation of the seat cushion in relation to the lower frame.

15. The shooting bench system of claim 11 comprising:

a plurality of levelers;

each of the plurality of levelers comprising a leveling mechanism and an extending leg;

the extending leg of each of the plurality of levelers being radially mounted to the lower frame; and the leveling mechanism being terminally mounted to the extending leg, offset from the lower frame.

16. The shooting bench system of claim 11 comprising:

the lower frame further comprising a plurality of floor holes; and the plurality of floor holes traversing through the non-slip floor.

* * * * *